United States Patent [19]

Isabell

[11] Patent Number: 4,685,682

[45] Date of Patent: Aug. 11, 1987

[54] ADJUSTABLE FLEX GOLF CLUB

[76] Inventor: James T. Isabell, P.O. Box 4017, Grand Junction, Colo. 81502

[21] Appl. No.: 742,903

[22] Filed: Jun. 10, 1985

[51] Int. Cl.[4] ..... A63B 53/00; A63B 69/36

[52] U.S. Cl. ..... 273/162 R; 273/80 B; 273/77 R; 273/194 R

[58] Field of Search ..... 273/77 R, 77 A, 80 B, 273/186 A, 193 B, 162 R

[56] References Cited

U.S. PATENT DOCUMENTS

| | | | |
|---|---|---|---|
| 2,992,828 | 7/1961 | Stewart | 273/80 B |
| 3,341,202 | 9/1967 | Stars | 273/77 R |

*Primary Examiner*—George J. Marlo

*Attorney, Agent, or Firm*—Gregg I. Anderson

[57] ABSTRACT

A golf club including a grip, shaft and clubhead is modified by a variable flexure mechanism so that the flexibility of the shaft can be changed. The flexure mechanism increases or decreases the shaft flexibility by varying the tension in a wire extending between the club handle and the club head. The wire is held at a spaced relationship from a shaft of the club by a bridge which maximizes the effect of the small changes in tension in the wire, according to movement of a threaded connection between the wire and the club head. Increasing the tension in the flexure adjustment mechanism decreases the flexibility of the shaft and decreasing the tension increases the flexibility of the shaft. The golf club is used in a method to customize golf clubs for a given golfer by first establishing the golfer's clubhead speed and then correlating that clubhead speed to required club flexibility. The adjustable flex club is adjusted to the flexibility required and then used as a basis upon which other golf club shafts are matched to an individual golfer.

5 Claims, 10 Drawing Figures

ADJUSTABLE FLEX GOLF CLUB

BACKGROUND OF THE INVENTION

1. Field of the Invention

The present invention relates to golf clubs and associated apparatus used to measure the dynamics of a golfer's swing. More particularly, the present invention relates to golf club apparatus useful in deriving the specific flex or bend of a golf club shaft to provide optimum storage of energy for release as the clubhead meets the ball near the bottom of a downward golf swing as derived from the clubhead speed generated by a given golfer and measured near the bottom of the downward golf swing.

The amount of energy that can be stored within a flexing golf club shaft is proportional to the sustained acceleration that a given golfer can achieve. This sustained acceleration can be related through the apparatus of this invention to clubhead speed at the golf ball striking position at or near the bottom of the downward golf swing. Thus, the apparatus of the invention correlates measured clubhead speed to the specific shaft flex required for each golf club within a set of clubs for any given golfer.

2. Description of the Prior Art

Various factors or characteristics of a golf club are known to be of importance in customizing or matching a set of clubs to an individual golfer. Swing weight, and such factors as static weight, fit of the grip and flexibility of the shaft all have an effect on a golf swing of an individual.

It is well known to weigh golf clubs, both for purposes of determining the club's static weight and the swing weight. U.S. Pat. No. 2,595,717 to K. Smith and U.S. Pat. No. 3,577,771 to K. Solheim show as their primary purpose measurement of the static weight and swing weight of a set of clubs to fit an individual golfer's needs. It is common to adjust the static and swing weights in order to "groove" a swing. Specifically adjusting the flexibility of a shaft to an individual's swing speed has seldom been considered or done previously.

Flexibility of a golf club shaft is a factor that has been used in customizing a set of golf clubs to a specific player. R. Carroll, et al., U.S. Pat. No. 3,180,308 shows a gauge mounted at a grip of a golf club, the guage interconnected by an elongated arm to the clubhead. Upon swinging the club an indicator is moved and retains a flex distance setting at the point of maximum deflection resulting from flexure of the shaft during the golf swing. A flat brace is used to connect the outer end of the club head with the shaft at a point reasonably distant from the shaft in I. Palmer, U.S. Pat. No. 687,540. The purpose of the brace is to prevent the tendency of the clubhead to twist when the ball is struck, yet not hinder the resiliency or flexibility of the shaft.

The inertia of a swinging golf club is measurable by any one of a number of apparatus, one such apparatus seen in U.S. Pat. No. 4,212,193 to J. Turley. This moment of inertia may be thought of as the torque applied to accelerate the golf club to a maximum velocity. R. Adams, U.S. Pat. No. 1,953,916 measures the inertia of a golf club, in order to establish the swing weight, by a static measurement. Other swinging golf club testing devices include W. Wettlaufer, U.S. Pat. No. 2,108,877 and J. Crouch, et al., U.S. Pat. No. 3,371,523. Again, the primary, if not sole, purpose of the various testing devices is to measure the swing weight of a given golf club in an attempt to reach an ideal swing weight and then equalize swing weights among various clubs. The swing weight is varied, depending on the results of the tests, by varying the weight at the clubhead. Within limits, varying clubhead weight increases or decreases the amount of flex of a given golf club shaft during the dynamic action of a golf swing.

Other golf clubs useful in improving one's golf swing are seen in N. Mattison, U.S. Pat. No. 1,676,270, which gives an audible sound indicating a consistent swing, and R. Kunihisa, U.S. Pat. No. 3,318,602, used to effectively guage the length of the putting stroke and power behind the stroke.

None of the prior art correlates clubhead speed at impact with the ball to derive shaft flex or measures golf club shaft flexibility through a single club having an adjustable flex shaft. Neither does the prior art show any method for using clubhead speed and golf club shaft flexiblity to make a set of golf clubs for an individual golfer matched to that golfer's specific clubhead speed. Many adjustments to golf clubs in prior art consist of varying clubhead weight upon a given shaft. The apparatus of this invention provides for the standardization of clubhead weights for each club within a set, and for varying the golf club shaft flexibility as required to specifically match a given golfer's clubhead speed. Existing manufacturing techniques rely on static weighing and measuring processes during fabrication. The apparatus of this invention provides for correlating the dynamics of a golfer's swing into the fabrication of golf clubs.

OBJECTS AND SUMMARY OF THE INVENTION

The principal object of this invention is to provide a golf club head on an adjustable flex shaft used in a method to correlate the dynamics of a golfer's swing into a set of golf clubs of specific flex characteristics that will optimize energy storage within the golf club shaft during a golfer's downswing until the energy is released from the shaft as the clubhead strikes the ball. To achieve this objective a graph was developed which correlates golf club shaft flexibility in linear deflection to each one mile per hour change in measured clubhead speed. The golf club with the adjustable flex shaft is one part of the total apparatus of this invention.

In accordance with the object of the invention, clubhead speed is measured when flex of a golf club shaft is approximately correlated to a golfer's clubhead speed. Slight increases or decreases in shaft flexibility of the adjustable flex shaft club can create marked changes in measured clubhead speed. Therefore, initial clubhead speed measurements are taken and an adjustable flex club is roughly adjusted on a flexure board to correspond to an individual golfer's required linear shaft deflection. Subsequently, clubhead speeds are again measured and the shaft is finely adjusted to optimize clubhead speed at impact with the ball. A set of clubs is made that have the same flex characteristics as the optimum deflection obtained from the adjustable flex golf club.

The adjustable flex golf club includes a grip and a weighted clubhead interconnected by an elongated tubular shaft. The face of the clubhead is interconnected by a length of wire and associated flexure adjustment means to the shaft. The wire passes over and is connected to a bridge member mounted intermediate the grip and the clubhead. The connection between the wire and bridge member allows the wire to move relative to the bridge member.

The flexure adjustment means incorporated into the wire connection to the shaft or clubhead of the adjustable flex golf club adjusts the tension in the wire. Increasing the tension in the wire simulates, in a single golf club, a stiffer, less flexible shaft. Loosening the adjustment means increases the wire length and decreases the tension, simulating a less stiff, more flexible shaft.

Flex of the shaft is understood, for purposes herein, to be the linear deflection of a tip of the golf club shaft or, if the shaft is mounted to a clubhead, the deflection of the clubhead face at the sole of the clubhead. The linear deflection measurement made in the method of the presen invention is under static conditions. A predetermined amount of weight is applied to the clubhead and the linear deflection is measured by the flexure board to which the shaft is mounted.

DESCRIPTION OF THE PREFERRED EMBODIMENT

Figure 1:
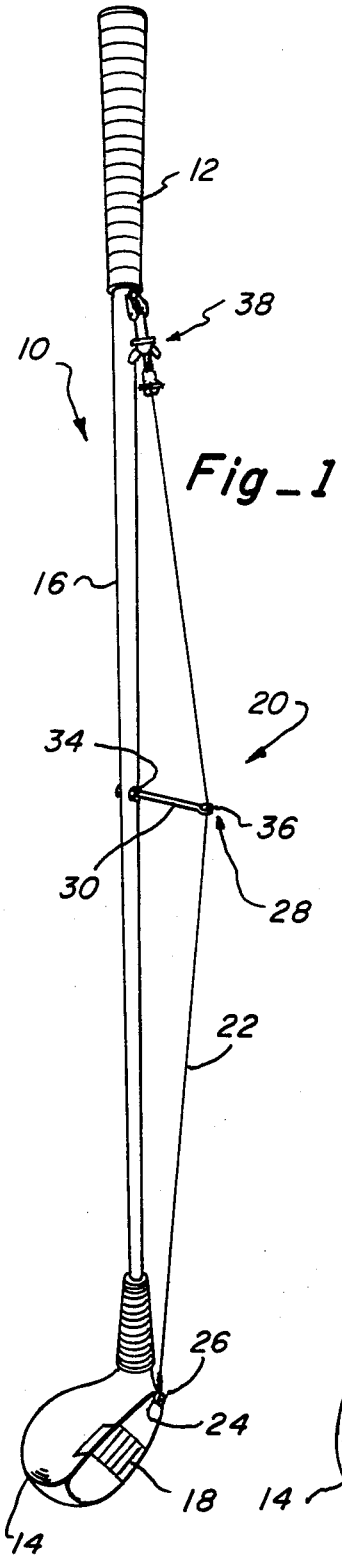
FIG. 1 is a perspective view of an adjustable flex golf club of the present invention.
Figure 2:
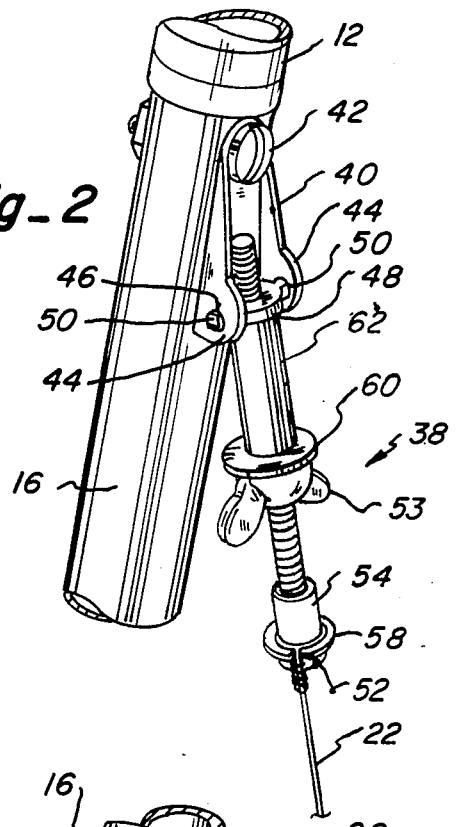
FIG. 2 is an enlarged fragmentary perspective view of a tension adjustment mechanism of the invention shown in FIG. 1.

An adjustable flex golf club 10 is seen in drawing FIG. 1 to include a grip 12 and a clubhead 14 interconnected by an elongated tubular shaft 16. The clubhead 14 includes a face 18 which in the normal manner is utilized to strike a golf ball (not shown) upon swinging the golf club 10 in a downward arcuate swing. As shown, the golf club 10 is a wood club, though the apparatus hereinafter described is applicable to all clubs, including irons.

A flexure adjustment mechanism 20 is incorporated in the golf club 10 for varying the rigidity or flexibility of the shaft 10. Flexibility of the shaft, or flex, is defined, for purposes of this disclosure, as the extent to which the shaft 16 will bend or deflect as the golf club 10 is swung, from a relatively straight unstressed mode at the top of a golf swing, to a stressed mode during the downward swing, in which the shaft bends or flexes. Upon striking the golf ball, the energy stored in the flexed or bent shaft 16 is released to impact a greater force to the golf ball.

The golf club 10 is used by a golfer who grasps the grip 12 and swings the clubhead downward in an arc toward the golf ball. The golf swing includes a back swing, in which the clubhead 14 is raised to a position above the head, and a downward swing, during which the club shaft 16 flexes, as herein defined.

Figure 10:
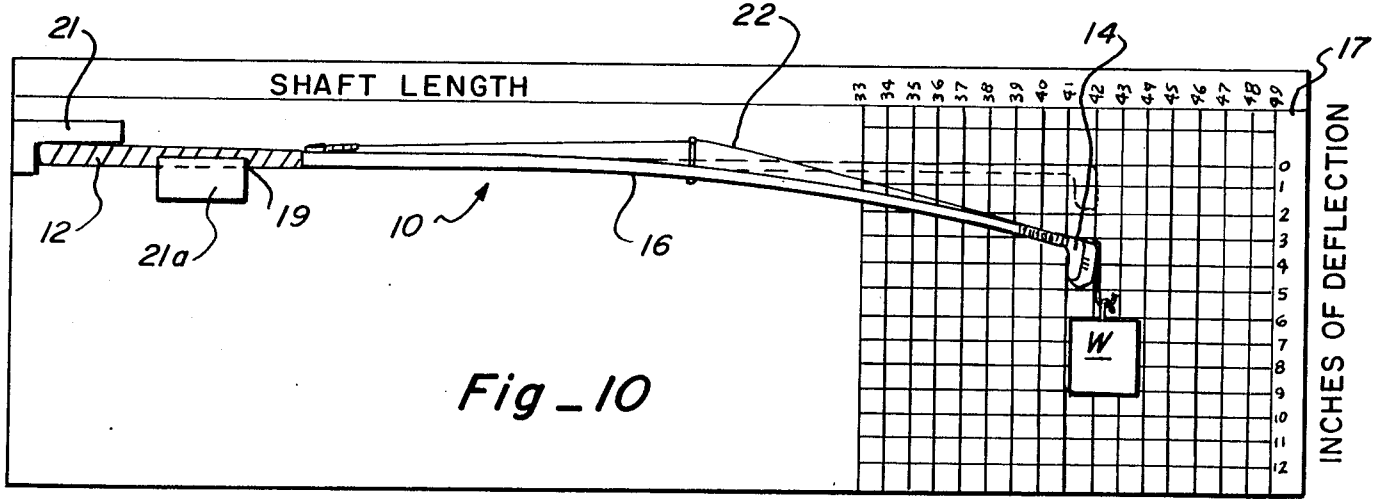
FIG. 10 is a side elevational view showing a flexure board which is used in conjunction with the invention shown in FIG. 1.

More specifically, flex of the golf club 10 is a measured linear deflection of a tip of the shaft 16 relative to the grip 12, measured at the sole of the clubhead 14. As seen in FIG. 10, the club 10 is held by a flexure board 17 in stationary position at the grip 12 connection to the shaft, a fulcrum 19 established at the second of two stationary blocks 21 and 21*a* about eight inches from the butt end of the grip 12. The shaft bends or deflects under the influence of a predetermined weight W, of approximately five pounds, in a direction away from the club face 18, as would occur in a downward swing. The deflection is measured by a vertical linear distance scale on the flex board 17. A horizontal linear distance scale of the flex board 17 is used to measure the club shaft length. The flex board 17 is parallel to the plane in which the golf club shaft deflects.

The flex of the shaft 16 is dependent upon the energy stored within the shaft derived from the clubhead speed of a given golfer, which is in turn dependent on the quickness and strength of the golfer. The faster a given golfer can swing a clubhead 14 of a given weight, the less flex will be necessary for the shaft 16. Conversely, the slower the clubhead 14 travels, the greater the flexibility required in the shaft 16.

Once the clubhead speed generated by the swing of a given golfer is known, then the shaft flexibility for that speed is determined. Using the flexure adjustment mechanism 20, the golf club 10 of the present invention is useful in varying the flex of the golf club to establish the ideal flex for a given golfer's swing. Once fully adjusted by the adjustment mechanism 20, the linear deflection of the golf club 10 of the invention can be matched with golf club shafts of like flexibility to construct a set of golf clubs that are ideally suited for a given golfer.

Figure 4:
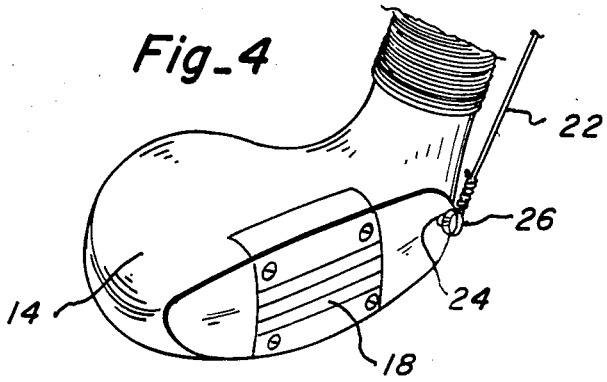
FIG. 4 is an enlarged fragmentary perspective view of a clubhead of the invention shown in FIG. 1.
Figure 7:
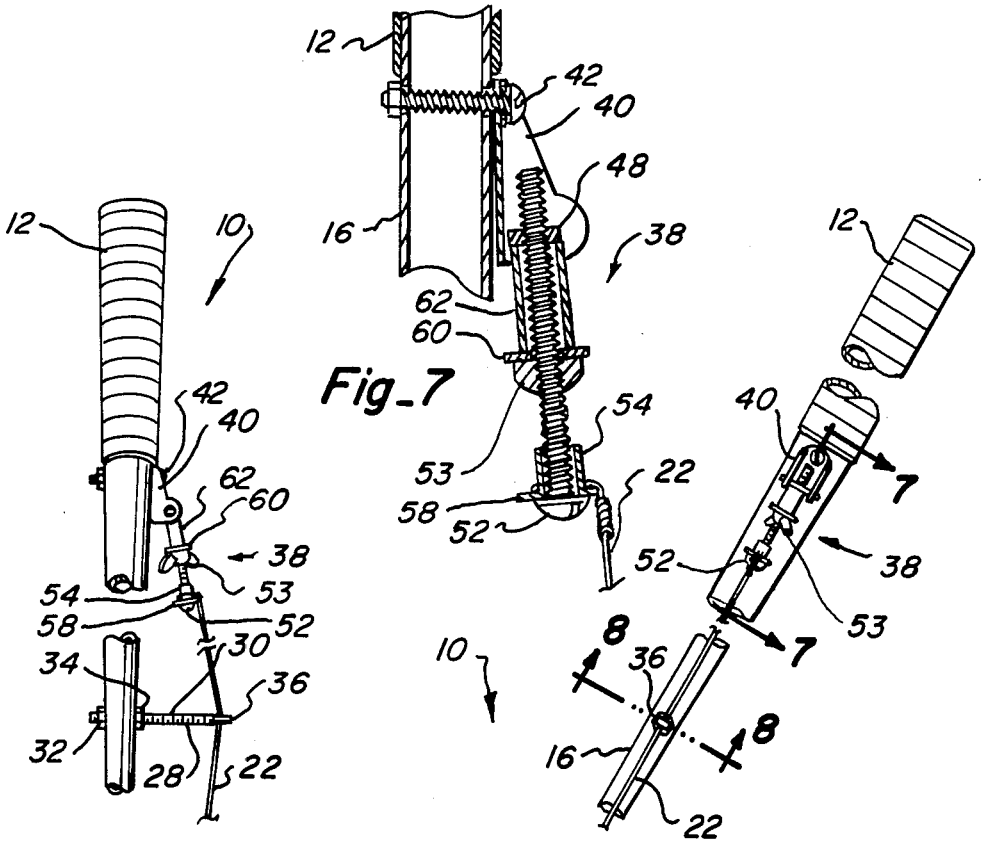
FIG. 7 is a fragmentary sectional view of the tension adjustment mechanism taken in the plane of line 7—7 of FIG. 6.
Figure 5:
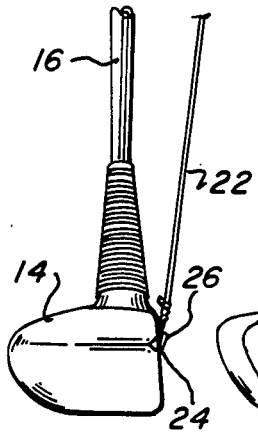
FIG. 5 is a fragmentary front elevational view of the invention shown in FIG. 1.
Figure 6:
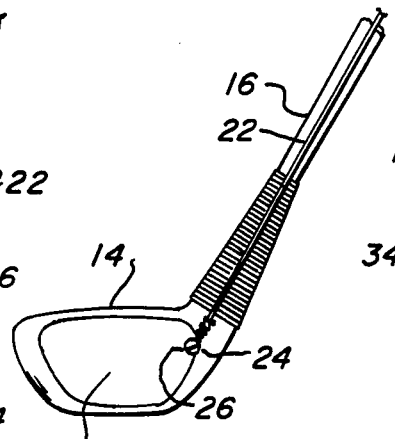
FIG. 6 is a fragmentary side elevational view of the invention shown in FIG. 1.

The flexure adjustment mechanism or flexure limiting means 20 has a connector or wire 22 interconnecting the golf clubhead 14 and the top of the bare shaft 16 where the shaft leaves the grip 12, which grip covers the shaft at one end. At the clubhead 14, the wire 22 is connected to a heel 24 of the clubhead 14 by a screw 26. (FIGS. 4–6). The screw 26, defining the connection of the wire 22 to the clubhead 14, is secured to the face 18 of the club. A bridge 28 is connected to and projects away from the shaft 16, the bridge leading or preceding the golf club 10 as the club is swung in the downward swing.

Figure 3:
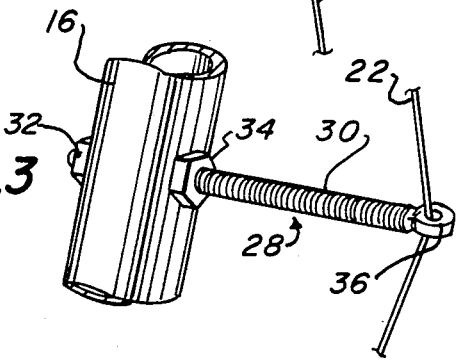
FIG. 3 is an enlarged fragmentary perspective view of a bridge of the invention shown in FIG. 1.
Figure 8:
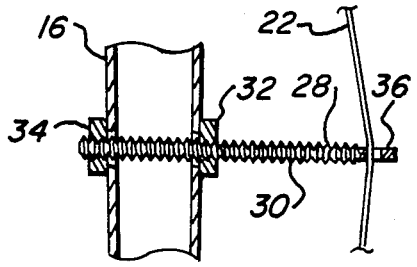
FIG. 8 is a fragmentary sectional view of the bridge taken in the plane of line 8—8 of FIG. 6.

The bridge 28 (FIGS. 3 and 8) is constructed from a bolt 30 passing through the shaft 16. A head 32 of the bolt is secured against the shaft 16 while a nut 34 holds the bolt securely in place, snuggly secured against the opposite side of the shaft 16 from the head 32. At the termination of the bolt 30, an eye 36 is integrally connected to the bolt, through which eye 36 the wire 22 passes to connect to a tension adjustment assembly 38. The wire 22 is held by the bridge 28 away from the shaft 16 to precede the golf club 10 in the downward swing.

The tension adjustment assembly 38 (FIGS. 1, 2, 5, 6 and 7) is connected to the shaft 16 at the grip 12. It is necessary that the tension assembly of the flexure mechanism 20 connect to the shaft 16 at points at least half the length of the entire shaft removed from the clubhead 14, the end of the grip 12 and the clubhead being preferrable. An anchor 40 of the the tension assembly 38 is secured by screw or other connection means 52 to the shaft 16. The anchor includes a pair of ears projecting away from the golf club 10, each of the ears having holes formed therein for receipt of arms 50 of a threaded swivel 48. The tbreaded swivel 48 receives and is threadably connected to an elongated bolt 52, defining a pivotal connection between the anchor and the bolt. A wing nut 53 is threaded onto the bolt, intermediate the swivel and bolt head. The wing nut is used for locking the threads of the bolt and is abuttable against a washer 60. The spacer 62 adjacent the washer 60 provides a stand-off from the threaded swivel 48 which allows the wing nut 53 to turn for locking or unlocking the bolt 52. A slide 54 with integral flange 58 provides a slideable means for anchoring the wire 22 to the adjustment mechanism 38. The wire 22 is connected to the flange portion 58 by any conventional connection process. Turning the wing nut 53 on the bolt 52 releases the lock and allows the bolt to be advanced or retracted through the threaded swivel. Advancing the bolt 52 and slide 54 toward the anchor 40 and away from the clubhead 1 pulls the wire 22 taut over the bridge 28. Retracting the bolt decreases the tension in the wire 22 and reduces the flex of the shaft 16.

As is clear from the foregoing description, the tension adjustment assembly 38 is used to increase or decrease the tension in the wire 22. The bridge 28 holds the wire 22 at a spaced distance away from the shaft 16. The resulting forces acting at the heel 24 and at the anchor 40 resist flexure of the shaft 16 during the downward swing. The greater the tension in the wire 22, the less flex in the shaft 16.

The method in which the golf club 10 is used, matches a golfer's clubhead speed with a desired shaft flex. Initially, the golfer uses the club of the present invention with the tension adjustment means 38 at a higher tension, so that there is a small amount of flex in the shaft 16 during the downward swing. Using available clubhead speed equipment, such as the Mitsubishi Golf Trainer, clubhead speeds are measured. From the clubhead speed, a direct correlation is made to the amount of flex required for the golf club of the particular golfer. The golf club 10 is adjusted to the amount of flex by the tension adjustment mechanism 38 until the proper flex or reflection is established relative to the flex board 17 under the influence of the weight W (FIG. 10), the shaft being mounted onto the flexure board 17. A number of golf balls are struck with the adjusted golf club 10. Any fine adjustment concerning flex is made by the tension adjustment assembly 38. The golf club 10 is again mounted to the flex board 17 and the weight W hung thereform. A curve tracing is made directly onto the coordinate system displayed on the flex board 17.

Shafts which approximate the amount of flex determined from the golf club 10 using the flexure board 17 and weight W (FIG. 10) are then picked, cut to match the flex curve tracing on the flex board 17 and a set of golf clubs made. A flex matched set of golf clubs is thereby customized to the individual golfer.

Figure 9:
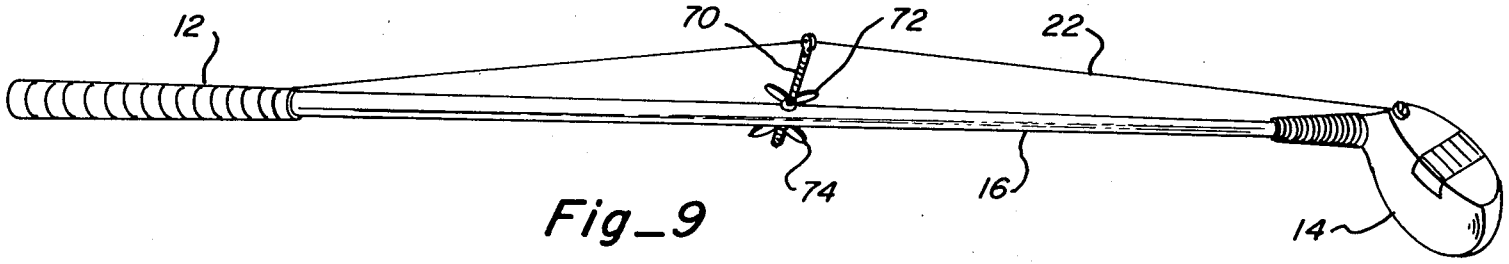
FIG. 9 is a side elevational view of an alternative embodiment of the invention.

An alternative embodiment of the golf club 10 is seen in FIG. 9 to include a bridge 70 passing through the shaft 16. The bridge has nuts 72 and 74 threadably connected thereon on either side of the shaft. Advancement or retraction of the nut 72 will increase or decrease the tension in the wire 22. The nut 74 is used to set the bridge position and lock in the desired flex. The wire 22 is fixedly connected as before in any conventional manner.

Though the invention has been described with a certain degree of particularity, the scope of the invention is more particularly set out in the appended claims.

What is claimed is:

1. An adjustable flex golf club, said golf club including a grip and clubhead interconnected by a shaft, comprising in combination:

a wire fixedly connected at one end to said clubhead and at the other end to said shaft, said wire slideably connected through a bridge mounted on said shaft and projecting away from said shaft at approximately a midpoint along the length of said wire, said wire connected to a tension adjustment mechanism mounted on said club having a bolt pivotally connected to said clubhead or shaft, said pivotal connection having an anchor with two ears having holes therein for receipt of a threaded swivel to which swivel the bolt is threadably connected, said wire mounted on said golf club to precede the golf club in a downward swing, whereby increasing the tension in the wire with the adjustment mechanism reduces the flex of the shaft and decreasing the tension increases the flex of the shaft.

2. The invention as defined in claim 1 wherein the tension adjustment mechanism decreases the length of said wire by advancement of said bolt to increase the tension in the wire and increasing the length of the wire by retraction of said bolt decreases the tension in the wire.

3. A golf club having a shaft, club head and grip for use in determining the amount of shaft flexibility a given golfer requires to optimize a golfer's club head speed during a swing, comprising in combination: flexure limiting means interconnecting the club head and the shaft, said flexure limiting means including an elongated wire fixed at one end to one of said club head or shaft, said flexure limiting means operatively connected at a second end of said wire to the other of said club head or shaft, said wire slidably connected to a bridge connected to said shaft at approximately a midpoint along the wire length, said bridge projecting away from said shaft, preceding the shaft in the downward swing, said flexure limiting means for limiting the extent to which the shaft flexes as the club head is moved through a downward swing to strike a golf ball and a tension adjustment assembly including a pivotal connection to said shaft which pivotal connection is threadably connected to an elongated bolt, one of said ends of said wire connected to a slide movable along the length of said bolt, said slide abutted against a nut threadably connected to said bolt, advancement of said bolt toward said pivotal connection increasing the tension in said wire and movement of said bolt away from said pivotal connection decreasing the tension in said wire, respectively decreasing or increasing the extent to which the shaft flexes during the downward swing.

4. The invention is defined in claim 3 wherein said pivotal connection further includes an anchor secured to one of said shaft or said club head, said anchor including two ears projecting away from said shaft in the direction of the downward swing, a hole formed in each ear for receipt of two radially projecting arms of a swivel having a centrally threaded hole for connection to the bolt.

5. A golf club having a shaft, club head and grip for use in determining the amount of shaft flexibility a given golfer requires to optimize the golfer's club head speed during a swing, comprising in combination:

flexure limiting means interconnecting the club head and the shaft, said flexure limiting means held at a spaced distance away from said shaft by a bridge adjustably connected thereto to vary its distance therefrom and connected to the shaft at a point at least one-half the golf club length away from the club head, said flexure limiting means for limiting the extent to which the shaft flexes as the club head is moved through a downward swing to strike a golf ball and including a tension adjustment assembly containing a wire interconnecting the club head to said shaft passing over the bridge projecting away from the shaft and adjustably connected to the shaft so as to vary the distance the bridge projects from the shaft and the resulting tension in said wire, said tension adjustment assembly operative for increasing or decreasing the tension in the wire, respectively decreasing or increasing the extent to which the shaft flexes during the downward swing.

* * * * *